US005626997A

United States Patent [19]

Mashimo et al.

[11] Patent Number: 5,626,997

[45] Date of Patent: May 6, 1997

[54] ELECTROPHOTOGRAPHIC PROCESS

[75] Inventors: Kiyokazu Mashimo; Fumio Ojima; Tomozumi Uesaka; Tomoo Kobayashi; Toru Ishii, all of Minami-ashigara, Japan

[73] Assignee: Fuji Xerox Co., Ltd., Tokyo, Japan

[21] Appl. No.: 396,729

[22] Filed: Mar. 1, 1995

[30] Foreign Application Priority Data

Mar. 4, 1994 [JP] Japan ..... 6-58355

[51] Int. Cl.[6] ..... G03G 13/24

[52] U.S. Cl. ..... 430/55; 430/31; 430/126

[58] Field of Search ..... 430/31, 55, 97, 430/126; 355/219, 220

[56] References Cited

U.S. PATENT DOCUMENTS

| | | | |
|---|---|---|---|
| 4,801,517 | 1/1989 | Frechet et al. | 430/59 |
| 4,806,443 | 2/1989 | Yanus et al. | 430/56 |
| 4,806,444 | 2/1989 | Yanus et al. | 430/56 |
| 4,937,165 | 6/1990 | Ong et al. | 430/59 |
| 4,959,288 | 9/1990 | Ong et al. | 430/59 |
| 4,983,482 | 1/1991 | Ong et al. | 430/59 |
| 5,034,296 | 7/1991 | Ong et al. | 430/59 |
| 5,164,779 | 11/1992 | Araya et al. | 355/219 |
| 5,371,578 | 12/1994 | Asano et al. | 355/219 |
| 5,402,218 | 3/1995 | Miyashiro et al. | 355/274 |
| 5,426,489 | 6/1995 | Haneda et al. | 355/219 |

FOREIGN PATENT DOCUMENTS 63-149669 6/1988 Japan .

OTHER PUBLICATIONS

Journal of Imaging Science 29 (1985), "A new class of Photoconductive Transport Materials: Substituted Phenyl and Diphenyl Acetaldehyde Enamines", S.L. Rice et al., pp. 7–10.

*Primary Examiner*—John A. McPherson
*Attorney, Agent, or Firm*—Oliff & Berridge

[57] ABSTRACT

In an electrophotographic process including an image forming process comprising a charging step of bringing a conductive charging member into contact with a surface of a photoreceptor and applying a superimposed voltage of a direct current voltage and an alternating current voltage to said conductive charging member to directly charge the surface of the photoreceptor, an image exposing step, and a developing step, the application of the voltage to said conductive charging member is stopped for every cycle of the image forming process, whereby the wear of the photoreceptive layer can be reduced and the life of the photoreceptor can be extremely improved.

5 Claims, 5 Drawing Sheets

ELECTROPHOTOGRAPHIC PROCESS

FIELD OF THE INVENTION

The present invention relates to an electrophotographic process in which a voltage-applied conductive member is brought into contact with a photoreceptor having an organic photoconductive material-containing photoreceptive layer formed on a conductive support, thereby charging a surface of the above-mentioned photoreceptor directly, and particularly, to an electrophotographic process which is applicable to electrophotographic devices, for example, image forming devices such as a plain paper copier (PPC), a laser printer, a LED printer and a liquid crystal printer.

BACKGROUND OF THE INVENTION

Previously, in electrophotographic devices such as a plain paper copier (PPC), a laser printer, a LED printer and a liquid crystal printer, a process has been frequently used in which an image forming process comprising electrification, exposure and development is applied to photoreceptors of the rotary drum type to form toner images, which are transferred to transfer members, followed by fixing, thus obtaining duplicated copies. As the photoreceptors used in these devices, inorganic photoreceptors such as selenium, arsenic-selenium, cadmium sulfide, zinc oxide and a-Si photoreceptors are employed, but organic photoreceptors (OPCs) inexpensive and excellent in productivity and waste disposal are also actively studied and developed. In particular, so-called function separation type photoreceptors in which charge generating layers are laminated with charge transporting layers are excellent in electrophotographic characteristics such as sensitivity, charge property and repetition stability thereof, so that various function separation type photoreceptors have been proposed and came in practice.

As units for charging these photoreceptors, corona charging units are generally widely used which comprises shield plates and thin wire electrodes such as gold-plated tungsten wires as main constituent members. However, these corona charging units have the problems that the devices themselves are large in size and high in cost, and produce a large amount of ozone, which causes generation of discharge products, resulting in image defects and unfavorable environmental circumstances. Then, recently, instead of these corona charging units having many problems, contact charging processes have been variously proposed in which surfaces of photoreceptors are brought into abutting contact with voltage-applied conductive members, thereby directly injecting charge into the surfaces of the photoreceptors to obtain a desired charge potential [JP-A-63-149669 (the term "JP-A" as used herein means an "unexamined published Japanese patent application"), etc.].

However, when these contact charging processes are applied to the conventional function separation type organic photoreceptors, repeated use of charging members in direct contact with the uppermost surface layers of the photoreceptors generally significantly wears away the uppermost surface layers to induce a reduction in charge property and changes in sensitivity. As a result, the problem is encountered that the life of the photoreceptors are extremely shortened, compared with the case of using the corona charging system. In particular, when a charge transporting layer in which a low-molecular charge transporting material is molecularly dispersed in a high-molecular binder resin is used as the uppermost surface layer of the photoreceptor, this effect is significant.

As to the wear of these photoreceptive layers, various causes are considered. However, in contact charging, direct charge locally flows in the charge transporting layer in which the low-molecular charge transporting material is dispersed in the binder resin. The stress is therefore applied not only to the surface of the photoreceptor, but also to the inside thereof. In a system in which a direct current (DC) voltage is used together with an alternating current (AC) voltage, the deterioration of the charge transporting material and the binder resin is promoted to a further deeper position. Further, locally ununiform dispersion of the charge transporting material also makes the deterioration thereof ununiform, so that the film strength of the photoreceptive layer is lowered, thus conceivably increasing the wear.

Further, the wear of these photoreceptive layers depends on the height and the frequency of the voltage in which the alternating current is superimposed on the direct current, particularly the alternating current voltage, and the time for which it is applied. The wear amount increases with increases in these values.

FIG. 3 is a timing chart at the time when the direct current voltage and the alternating current voltage are applied by superimposition to a contact charging unit to form images, in a conventional image forming device, wherein the thick line means the switch-on state. As is shown in FIG. 3, in the conventional image forming device, the superimposed voltage of the direct current voltage and the alternating current voltage is continuously applied to the conductive member of the charging unit through each image forming cycle. As a result, the stress is always applied to the surface of the photoreceptor, during operation of the image forming device.

SUMMARY OF THE INVENTION

It is an object of the present invention to solve the problem of the conventional techniques. Namely, an object of the present invention is to provide a electrophotographic process in which the wear of a photoreceptive layer is reduced and the life of a photoreceptor is significantly improved.

In order to solve the above-mentioned problem, the present inventors have conducted intensive investigation. As a result, the present inventors have discovered that the wear of these photoreceptive layers can be reduced even in the contact charging process by stopping the application of the superimposed voltage to the conductive members for the time between respective cycles of the image forming process, thus completing the present invention.

According to the present invention, there is provided an electrophotographic process including an image forming process comprising a charging step of bringing a conductive charging member into contact with a surface of a photoreceptor and applying a superimposed voltage of a direct current voltage and an alternating current voltage to said conductive charging member to directly charge the surface of the photoreceptor, an image exposing step, and a developing step, wherein the application of the voltage to said conductive charging member is interrupted in every cycle of the image forming process.

DETAILED DESCRIPTION OF THE INVENTION

The present invention is described below in detail.

Figure 4:
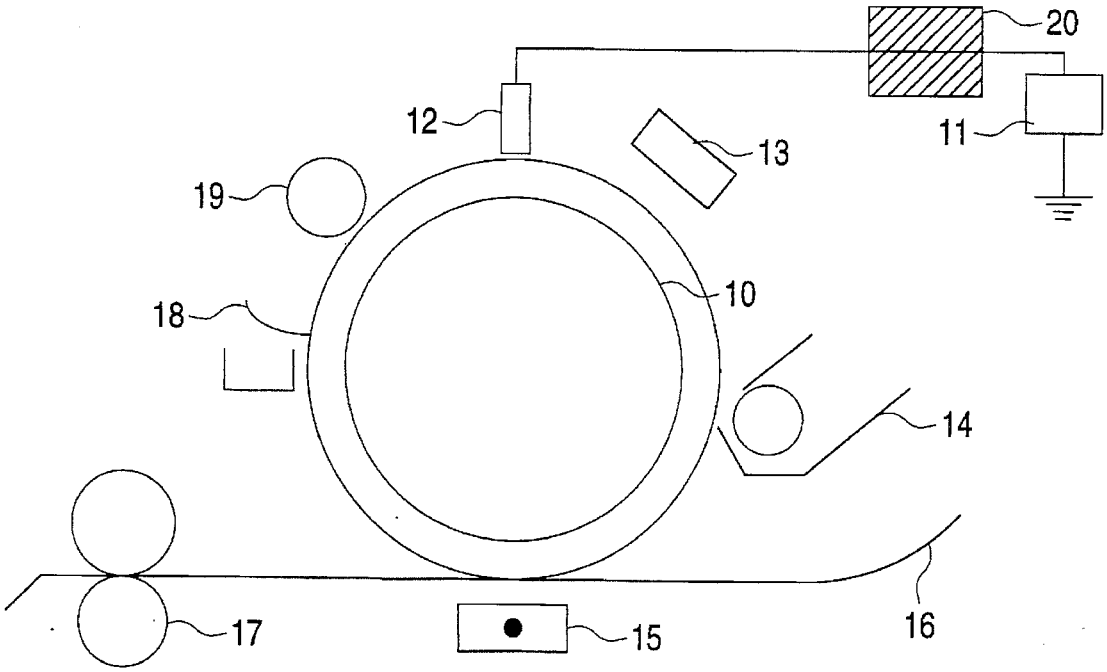
FIG. 4 is a schematic representation showing an image forming device used in the present invention.
Figure 5:
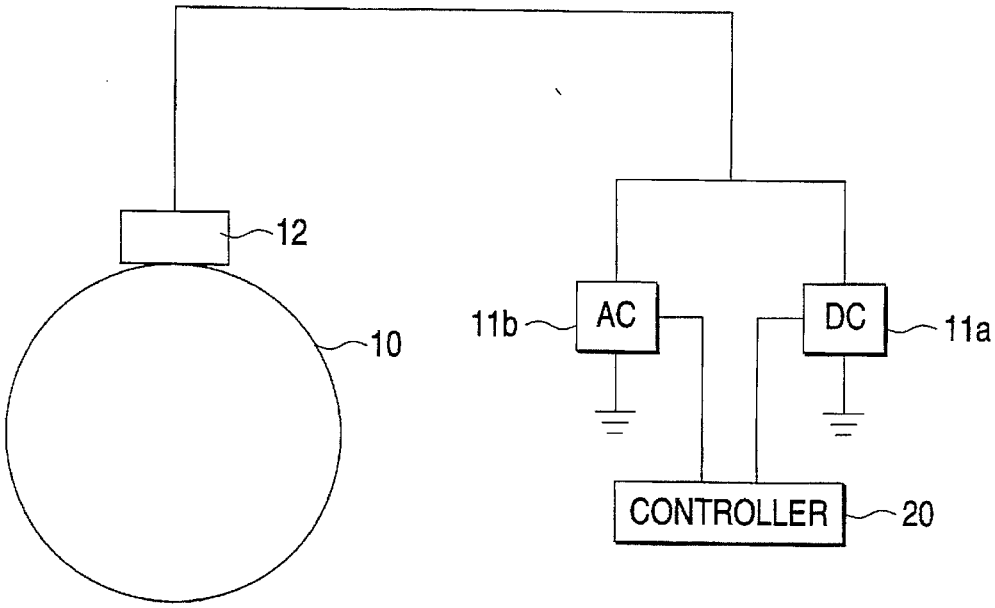
FIG. 5 is a representation for illustrating a main part of the image forming device used in the present invention.

FIG. 4 is a schematic representation showing one embodiment of an image forming device used in the present invention, and FIG. 5 is a representation for illustrating a main part thereof. The image forming device comprises a cylindrical photoreceptor 10, a charging unit 12 having a conductive member coming into contact with a surface thereof, an exposing unit 13 and a developing unit 14, and is further provided with a power supply 11 for applying an superimposed voltage of a direct current voltage and an alternating current voltage to the conductive charging member. A control means 20 for controlling the application of the voltage is connected to the power supply 11. On-off signals are transmitted from the control means 20 to a direct current power supply 11*a* and an alternating current power supply 11*b*, respectively. In addition, the image forming device of the present invention is provided with a transfer unit 15, a cleaning unit 18, a charge removing unit 19 and a fixing unit 17. The reference numeral 16 designates transfer paper.

In the photoreceptor constituting the image forming device used in the electrophotographic process of the present invention, a photoreceptive layer thereof may be either of a monolayer structure or of a laminated structure.

Figure 6:
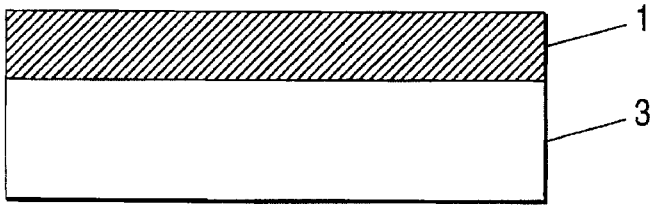
FIGS. 6(*a*) to 6(*f*) are schematic cross sectional views showing photoreceptors used in the present invention.
Figure 6:
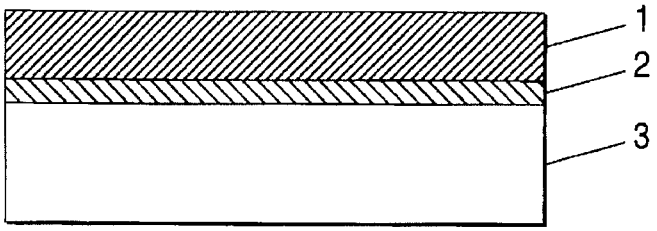
Figure 6:
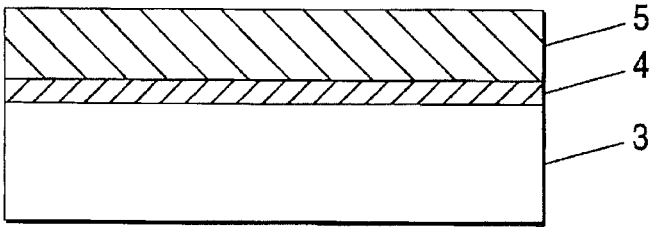
Figure 6:
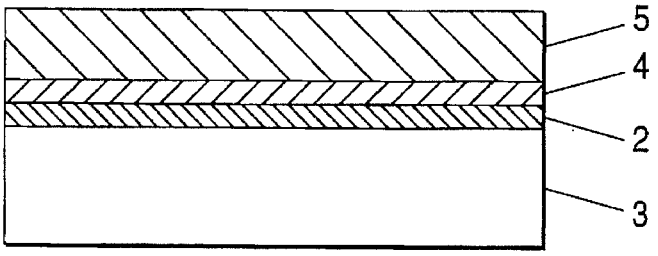
Figure 6:
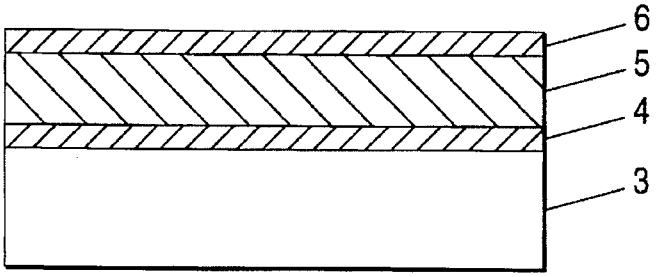
Figure 6:
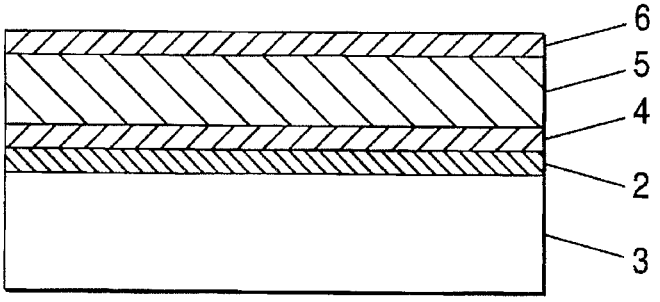

FIGS. 6(*a*) to 6(*b*) are schematic cross sectional views showing photoreceptors used in the present invention. FIGS. 6(*a*) and 6(*b*) show the cases that the photoreceptive layers are of the monolayer structure, wherein the photoreceptive layers 1 are formed on conductive supports 3. In FIG. 6(*b*), a subbing layer 2 is further provided thereon. FIGS. 6(*c*) to 6(*f*) show the cases that the photoreceptive layers are of the laminated structure. In FIG. 6(*c*), a charge generating layer 4 and a charge transporting layer 5 are formed in turn on a conductive support 3. In FIG. 6(*d*), a subbing layer 2 is further provided on the conductive support 3. In FIGS. 6(*e*) and 6(*f*), surface protective layers 6 are further formed on the charge transporting layers 5.

The conductive supports include metals such as aluminum, nickel, chromium and stainless steel; plastic films provided with thin films such as aluminum, titanium, nickel, chromium, stainless steel, gold, vanadium, tin oxide, indium oxide and ITO films; paper coated or impregnated with a conductivity imparting agent; and plastic films. These conductive supports are used in appropriate form such as drum, sheet or plate form, but are not limited thereto.

The surface of the conductive support can be further subjected to various treatments as so desired, as long as images are not affected. For example, the surface can be subjected to oxidation treatment, chemical agent treatment, coloring treatment or diffused reflection treatment such as sand dressing.

Further, a subbing layer may be provided between the conductive support and the charge generating layer. The subbing layer prevents the charge from being injected from the conductive support into the photoreceptive layer in charging the photoreceptive layer of the laminated structure, and serves as an adhesive layer for adhering the photoreceptive layer to the conductive support as an integral body or as a layer for preventing reflected light of the conductive support in some cases.

The binder resins used as the subbing layers include polyethylene resins, polypropylene resins, acrylic resins, methacrylic resins, polyamide resins, vinyl chloride resins, vinyl acetate resins, phenol resins, polycarbonate resins, polyurethane resins, polyimide resins, vinylidene chloride resins, polyvinyl acetal resins, vinyl chloride-vinyl acetate copolymers, polyvinyl alcohol resins, water-soluble polyester resins, nitrocellulose, casein, gelatin, polyglutamic acid, starch, starch acetate, amino starch, polyacrylic acid, polyacrylamide, zirconium chelate compounds, titanyl chelate compounds, titanyl alkoxide compounds, organic titanyl compounds and silane coupling agents. These materials may be used alone or as a mixture of two or more kinds of them.

Further, fine particles of titanium oxide, silicon oxide, zirconium oxide, barium titanate, a silicone resin or the like can be incorporated therein. The thickness of the subbing layer is suitably 0.01 to 10 μm, and preferably 0.05 to 2 μm.

Examples of charge generating materials used in the charge generating layer of the present invention include inorganic photoconductive materials such as amorphous selenium, crystalline selenium-tellurium alloys, selenium-arsenic alloys, other selenium compounds and selenium alloys, zinc oxide and titanium oxide, and organic pigments and dyes such as phthalocyanine series, squarelium series, anthoanthrone series, perylene series, azo series, anthraquinone series, pyrene series, pyrylium salts and thiapyrylium salts.

In particular, non-metallic phthalocyanines and metallic phthalocyanines such as vanadyl, titanyl, tin chloride, indium chloride, gallium chloride and gallium hydroxide phthalocyanines are preferred.

Further, binder resins used in the charge generating layer include but are not limited to polyvinyl butyral resins, polyvinyl formal resins, partially modified polyvinyl acetal resins, polycarbonate resins, polyester resins, acrylic resins, polyvinyl chloride resins, polystyrene resins, polyvinyl acetate resins, vinyl chloride-vinyl acetate copolymers, silicone resins, phenol resins and poly-N-vinylcarbazole. These binder resins can be used alone or as a mixture of two or more kinds of them.

The compounding ratio (weight ratio) of the charge generating material to the binder resin is preferably within the range of 10:1 to 1:10. Further, the thickness of the charge generating material used in the present invention is generally 0.1 to 5 μm, and preferably 0.2 to 2.0 μm.

The charge transporting layer is formed by adding a charge transporting material to an appropriate binder. Examples of the charge transporting materials include but are not limited to oxadiazole derivatives such as 2,5-bis(p-diethylaminophenyl)-1,3,4-oxadiazole, pyrazoline derivatives such as 1,3,5-triphenylpyrazoline and 1-[pyridyl-(2)]-3-(p-diethylamino-styryl)-5-(p-diethylaminophenyl) pyrazoline, aromatic tertiary amino compounds such as triphenylamine and dibenzylaniline, aromatic tertiary diamino compounds such as N,N'-diphenyl-N,N'-bis-(3-methylphenyl)-[1,1'-biphenyl]-4,4'-diamine, 1,2,4-triazine derivatives such as 3-(4'-diethylaminophenyl)-5,6-di-(4'-methoxyphenyl)-1,2,4-triazine, hydrazone derivatives such as 4-diethylaminobenzaldehyde-1,1'-diphenylhydrazone, quinazoline derivatives such as 2-phenyl-4-styrylquinazoline, benzofuran derivatives such as 6-hydroxy-2,3-di(p-methoxyphenyl)benzofuran, α-stilbene derivatives such as p-(2,2'-diphenylvinyl)-N-N-diphenylaniline, enamine derivatives described in *Journal of Imaging Science*, 29, 7–10 (1985), poly-N-vinylcarbazole and derivatives thereof such as N-ethylcarbazole, poly-γ-carbazoleethylglutamate and derivatives thereof, and further known charge transporting materials such as pyrene, polyvinylpyrene, polyvinyl-anthracene, polyvinylacridine, poly-9-biphenylanthracene, pyrene-formaldehyde resins and ethylcarbazole-formaldehyde resins. These charge transporting materials can be used alone or as a mixture of two or more kinds of them.

Furthermore, examples of the binder resins used in the charge transporting layer include but are not limited to known resins such as polycarbonate resins, polyester resins, methacrylic resins, acrylic resins, polyvinyl chloride resins, polyvinylidene chloride resins, polystyrene resins, polyvinyl acetate resins, styrene-butadiene copolymers, vinylidenechloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, stylene-alkyd resins and poly-N-vinylcarbazole. These binder resins can be used alone or as a mixture of two or more kinds of them.

Of these binder resins, polycarbonate resins represented by the following structural formulas (I) to (VI) or polycarbonate resins in which repeating structural units constituting them are copolymerized are preferably used alone or as a mixture of two or more kinds of them. In this case, the binder resins are compatible with the charge transporting materials, so that uniform films are obtained. The molecular weight of the polycarbonate resins which exhibit particularly good characteristics ranges from 10,000 to 100,000 in viscometric average molecular weight, and preferably from 10,000 to 50,000.

(I)

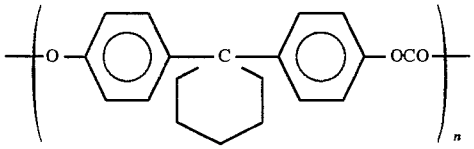

(II)

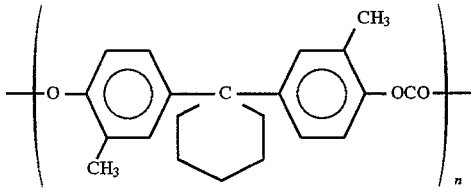

(III)

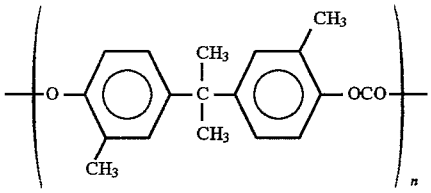

(IV)

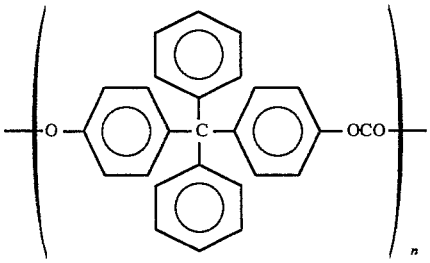

(V)

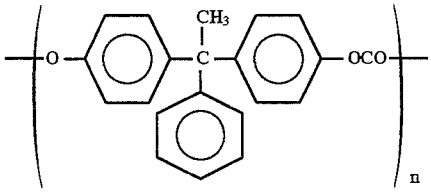

-continued (VI)

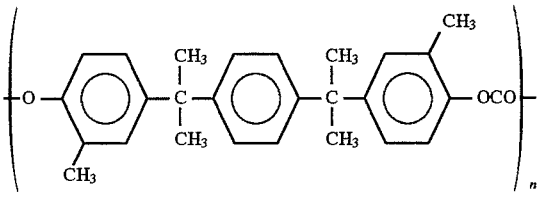

The compounding ratio (weight ratio) of the charge transporting material to the binder resin is preferably 10:1 to 1:5. The thickness of the charge transporting material used in the present invention is generally 5 to 50 μm, and preferably 10 to 30 μm.

As the charge transporting material, a polymeric charge transporting material in which a charge transporting material itself is polymerized may also used. Examples of such the charging transporting material include polymeric compounds described in U.S. Pat. Nos. 4,806,443, 4,806,444, 4,801,517, 4,937,165, 4,959,288, 5,034,296, and 4,983,482.

Further, in order to prevent the deterioration of the photoreceptors due to ozone, oxidizing gases, light or heat generated in the copying machines, additives such as oxidizing agents, light stabilizers and heat stabilizers can be added to the charge transporting layers. These additive may be used in an amount of 0.01 to 10 wt %, preferably 0.1 to 5 wt % based on the solid content of the charge transporting layer. The solid content of the charge transporting layer generally means the total amount of the binder resin and the charge transporting material in the charge transporting layer, more specifically, the total amount of solid content except solvents which is to be removed by drying.

The examples of the oxidizing agents include hindered phenols, hindered amines, p-phenylenediamine, arylalkanes, hydroquinone, spirochroman, spiroindanone, derivatives thereof, organic sulfur compounds and organic phosphorus compounds.

Examples of the light stabilizers include derivatives of benzophenone, benzotriazole, dithiocarbamates and tetramethylpiperidine. For the purposes of improving the sensitivity, decreasing the residual potential and reducing the wear on repeated use, at least one kind of electron acceptable material can be added. The electron acceptable materials which can be used in the photoreceptors of the present invention include, for example, succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Of these, the fluorenone series, the quinone series and the benzene derivatives having electron withdrawing substituent groups such as Cl, CN and $NO_2$ are particularly preferred.

in the present invention, for the main purpose of obtaining good surface property, an additive can be added to the charge transporting layer. As the additives of this kind, ones known as modifiers for paints can be used. Preferred examples thereof include alkyl-modified silicone oil such as dimethylsilicone oil and aromatic-modified silicone oil such as methylphenylsilicone oil. These additives may be added in an amount of 1 to 10,000 ppm, preferably 5 to 2,000 ppm, based on the solid content of the charge transporting layer.

The surface protective layer may be further formed on the charge transporting layer as so desired. The surface protective layer shows the functions of preventing the charge transporting layer from chemically deteriorating when the photoreceptive layer of the laminated structure is charged and improving the mechanical strength of the photoreceptive layer.

This surface protective layer is formed by adding a conductive material to an appropriate binder resin. The conductive materials which can be used include but are not limited to metallocene compounds such as N,N'-dimethylferrocene, aromatic amine compounds such as N,N'-diphenyl-N,N'-bis(3-methylphenyl)-[1,1'-biphenyl]-4,4'-diamine, and metal oxides such as antimony oxide, tin oxide, titanium oxide, indium oxide and tin oxide-antimony oxide. Further, the binder resins used in the surface protective layers include known resins such as polyamide resins, polyurethane resins, polyester resins, epoxy resins, polyketone resins, polycarbonate resins, polyvinylketone resins, polystyrene resins and polyacrylamide resins.

In the surface protective layer, the conductive material is used in an amount of 25 to 300 parts by weight based on 100 parts of the binder resin.

It is preferred that the above-mentioned surface protective layer is formed so as to give an electric resistance of $10^9$ to $10^{14}$ Ω·cm. An electric resistance of more than $10^{14}$ Ω·cm causes an increase in residual potential, resulting in a copy having many stains, whereas an electric resistance of less than $10^9$ Ω·cm brings about a blurred image and a reduction in resolution.

In addition, the surface protective layer must be formed so that the transmission of light used for image exposure is not substantially prevented. The thickness of the surface protective layer is suitably 0.5 to 20 μm, and preferably 1 to 10 μm.

The charging unit used in the image forming device of the present invention has the conductive member coming into contact with the surface of the photoreceptive layer. The conductive unit may be in any of brush, blade, pin electrode and roller forms. The roller-like member is preferably used among others. In general, the roller-like member comprises a resistive layer provided outside, an elastic layer for supporting it, and a core member. A protective layer may be further formed on the outside of the resistive layer if necessary.

The core member is of a conductive material, and generally, iron, copper, brass, stainless steel, aluminum or nickel is used. In addition, a resin shaped article can also be used in which conductive particles are dispersed.

The elastic layer is of a conductive or semiconductive material, and generally, a rubber member can be used in which conductive or semiconductive particles are dispersed.

The rubber members used herein include EPDM, polybutadiene, natural rubber, polyisobutylene, SBR, CR, NBR, silicone rubber, urethane rubber, epichlorohydrin rubber, SBS, thermoplastic elastomers, norbornene rubber, fluorosilicone rubber and ethylene oxide rubber. Examples of the conductive or semiconductive particles include carbon black, metals such as zinc, aluminum, copper, iron, nickel, chromium and titanium, and metal oxides such as ZnO—$Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $Sb_2O_3$, $In_2O_3$, ZnO and MgO. These materials may be used alone or as a mixture of two or more kinds of them. When two or more kinds or them are used, one may be in particle form. Further, fine particles of fluorine resins can also be used.

As to the resistive layer and the protective layer, conductive or semiconductive particles are dispersed in a binder resin to regulate its resistance. The resistivity is $10^3$ to $10^{14}$ Ω·cm, preferably $10^5$ to $10^{12}$ Ω·cm, and more preferably $10^7$ to $10^{12}$ Ω·cm. Further, the thickness thereof is set within the range of 0.01 to 1,000 μm, preferably 0.1 to 500 μm, and more preferably 0.5 to 100 μm.

The binder resins include acrylic resins, cellulose resins, polyamide resins, methoxymethylated nylon, ethoxymethylated nylon, polyurethane resins, polycarbonate resins, polyethylene resins, polyvinyl resins, polyarylate resins, polythiophene resins, 4-ethylene fluoride-6-propylene fluoride resin (FEP), polyester resins such as polyethylene terephthalate, polyolefin resins and styrene-butadiene resins.

As the conductive or semiconductive particles, carbon black, the metals and the metal oxides used in the elastic layer are used.

Furthermore, there can be added antioxidants such as hindered phenols and hindered amines, fillers such as clay and kaolin, lubricants such as silicone oil, as so desired.

Means for forming these layers include blade coating, wire bar coating, spray coating, dip coating, bead coating, air knife coating, curtain coating, vacuum deposition and plasma coating.

To the charging unit having the above-mentioned conductive member, the voltage in which the alternating voltage is superimposed on the direct voltage is applied by a voltage-applying means. The range of the voltage applied by the voltage-applying means is preferably 50 to 2,000 V in positive or negative, and more preferably 100 to 1,500 V in positive or negative for the direct voltage. The voltage between peaks is 200 to 2,000 V, preferably 400 to 1,600 V, and more preferably 800 to 1,600 V for the alternating voltage to be superimposed. If the voltage between peaks exceeds 2,000 V, uniform charge can not be obtained compared with the case that the alternating voltage is not superimposed. It is preferred that the alternating voltage has a frequency of 50 to 2,000 Hz.

The electrophotographic process of the present invention is conducted using the image forming device described above. In the charging step, the conductive charging member of the charging unit 12 is brought into contact with the surface of the photoreceptor 10 and the superimposed voltage of the direct current voltage and the alternating current voltage is applied to said conductive charging member by the power supply 11, the voltage applying means, to directly charge the surface of the photoreceptor, thereby performing uniform electrification. Then, in the image exposing step, image exposure is carried out by the exposing unit 13, and in the developing step, latent images formed by use of toner are developed. Further, developed toner images are transferred to the transfer paper 16, fixed, and shifted to the subsequent image forming cycle. In the electrophotographic process of the present invention, the voltage to be applied is controlled according to sequential control by the control means 20 to interrupt the application of the voltage to said conductive charging member in every cycle of the image forming process.

Figure 1:
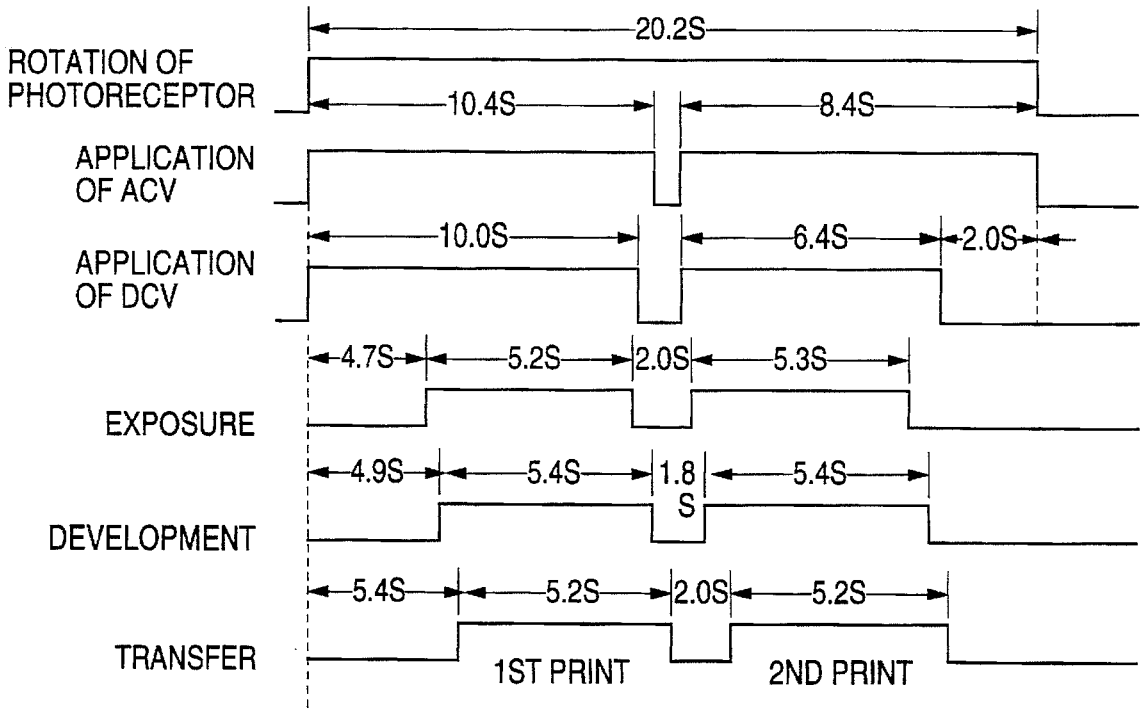
FIG. 1 is a timing chart in an electrophotographic process of the present invention.
Figure 2:
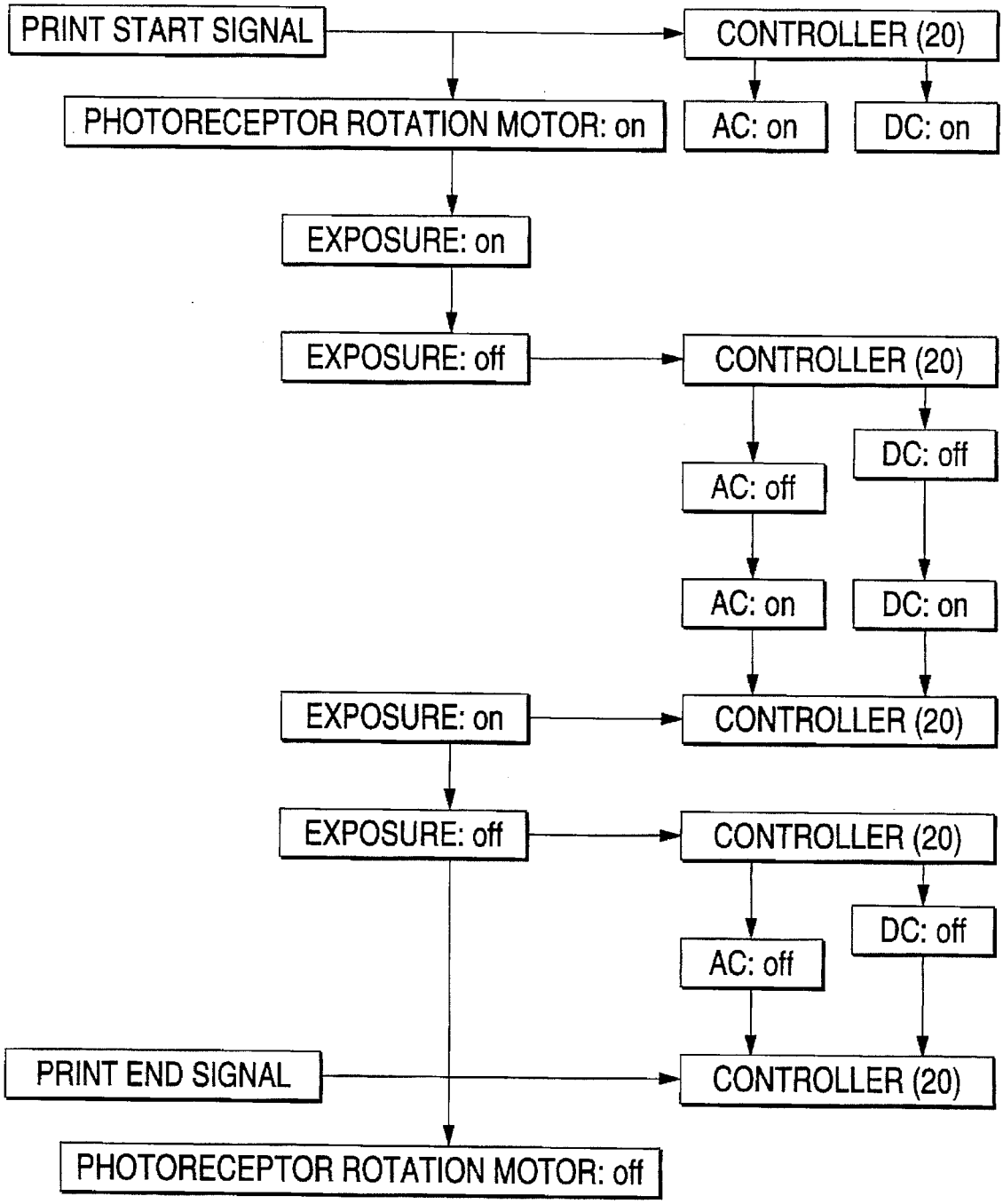
FIG. 2 is a flow chart for illustrating the operation shown in FIG. 1.

FIG. 1 is a timing chart showing the respective steps in the present invention, wherein portions indicated by the thick lines show the switch-on state. Further, FIG. 2 is a flow chart for illustrating the operation shown in FIG. 1. As is shown in FIGS. 1 and 2, in the present invention, the application of the direct current voltage and the alternating current voltage is controlled according to sequential control. Namely, the direct current voltage and the alternating current voltage are first applied at the same time that rotation of the photoreceptor is started, based on a signal fed from the control means 20, followed by exposure, development and transfer. At a definite time after the first image formation has been performed on the photoreceptor and an exposure signal has been stopped, the direct current voltage and successively the alternating current voltage are stopped from being applied in this order. In this case, the direct current voltage is preferably stopped from being applied just after the stop of exposure and just before the stop of development, and the alternating current voltage is preferably stopped from being applied just after the stop of development and just before the stop of transfer. If the direct current voltage is lowered before the stop of exposure, there may be a case that a charging potential necessary for image formation cannot be given to the photoreceptor. Then, at a definite time before an exposure signal for the second image formation cycle is sent, the direct current voltage and the alternating current voltage are applied again at the same time with a switch. The timing for restarting both the DC and AC voltages is preferably just before restarting an exposure when the applications of exposure, development and transfer are respectively restarted in this order. This is because an elastic latent image necessary for forming an image may not be given to the photoreceptor in the case of lacking the degree of the application of voltage to a charging member. In particular, the above timing is important for reducing a loss of time in forming an image efficiently. As a result, the stress applied to the surface of the photoreceptor can be reduced.

According to the electrophotographic process of the present invention, for the photoreceptive layer in which the conventional charge transporting material is molecularly dispersed in the contact charging process, the application of the voltage to the conductive charging member is interrupted in every cycle of the image forming process. Accordingly, when images are formed, the stress is not always applied to the surface of the photoreceptor by the charging unit. As a result, the wear of the photoreceptive layer can be reduced and the life of the photoreceptor can be extremely improved.

In the following examples, the application of the voltage to the conductive charging member is interrupted in every cycle of the image forming process. However, taking a plurality of image forming processes as one group, the application of the voltage can also be interrupted during an interval between the groups (after image exposing). In particular, in a high-speed process, such establishment are preferably used.

Further, in the following examples, the direct current voltage and the alternating current voltage are stopped from being applied in this order. The reason for this is that when the direct current voltage is stopped from being applied before the alternating current voltage, the charge on the photoreceptor can be homogenized by the alternating electric field to prevent troubles such as toner adhesion from being made on a portion corresponding to a charge stop region on the photoreceptor.

The wear of the photoreceptor can be reduced by interrupting the application of the alternating current voltage. The wear of the photoreceptor is considered to be caused by slight discharge of the alternating current voltage from the conductive charging member to the surface of the photoreceptor. The gap between the conductive charging member and the surface of the photoreceptor caused by the rotation of the photoreceptor is about 7 to 8 μm.

The present invention will be described with reference to the following examples, but it is to be understood that the invention is not limited thereto.

EXAMPLE 1

A solution of 10 parts of a zirconium compound (trade name: Orgastic ZC540, manufactured by Matsumoto Seiyaku Co.) and 1 part of a silane compound (trade name: A1110, manufactured by Nippon Unicar Co., Ltd. ) in 40 parts of i-propanol and 20 parts of butanol was applied to a surface of an aluminum pipe by dip coating, and dried by heating at 150° C. for 10 minutes to form a subbing layer having a thickness of 0.1 μm. Then, 1 part of x type nonmetallic phthalocyanine crystals was mixed with 1 part of a polyvinyl butyral resin (trade name: S-lec BM-s, manufactured by Sekisui Chemical Co., Ltd.) and 100 parts of cyclohexanone, and the mixture was treated together with glass beads in a sand mill for dispersion. Then, the resulting coating solution was applied on the above-mentioned subbing layer by dip coating, and dried by heating at 100° C. for 10 minutes to form a charge generating layer having a thickness of 0.15 μm.

A coating solution in which 3 parts of the triphenylamine compound represented by the following structural formula as the charge transporting material and 3 parts of the polycarbonate resin (viscometric average molecular weight: 40,000) represented by the above-mentioned structural formula (III) as the binder resin were dissolved in a mixed solution of 10 parts of monochlorobenzene and 10 parts of tetrahydrofuran was applied on the charge generating layer by dip coating, and dried by heating at 115° C. for 1 hour to form a charge transporting layer having a thickness of 20 μm.

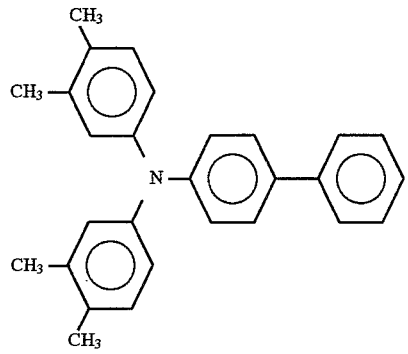

Then, using a 6-mm diameter stainless steel rod as the core member, conductive EPDM rubber having a resistivity of $10^6$ Ω·cm as the elastic layer, and epichlorohydrin rubber having a resistivity of $10^9$ Ω·cm as the resistive layer, a 12-mm diameter conductive roll was formed.

The photoreceptor and the conductive member thus obtained were mounted on a laser beam printer (a modified XP-11 printer in which a charging unit having a conductive member is incorporated, manufactured by Fuji Xerox Co., Ltd.), and the direct current voltage (−550 V) and the alternating current voltage (1400 V (voltage between peaks) /frequency of 800 Hz) were applied so as to take the timing as shown in FIG. 1 to conduct printing, thereby evaluating image quality. Thereafter, this printing procedure was repeated 50,000 cycles, and image quality after 50,000 cycles was evaluated and the wear amount of the charge transporting layer was measured. Results thereof are shown in Table 1.

COMPARATIVE EXAMPLE 1

Figure 3:
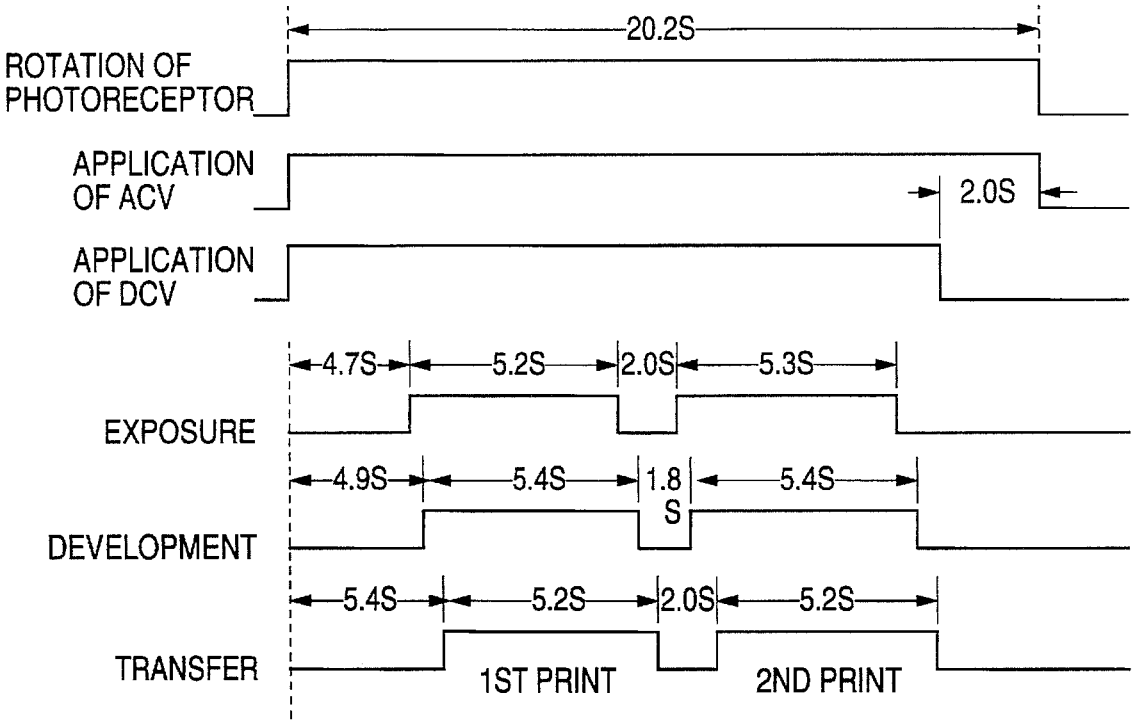
FIG. 3 PRIOR ART
FIG. 3 is a timing chart in a conventional electrophotographic process.

The evaluation was performed in the same manner as with Example 1 with the exception that the image formation was conducted according to the timing shown in FIG. 3. Results thereof are shown in Table 1.

COMPARATIVE EXAMPLE 2

The photoreceptor of Example 1 was mounted on a normal laser beam printer (XP-11, manufactured by Fuji Xerox Co., Ltd.) in which electrification is carried out by a scorotron, and the image formation was performed, followed by similar evaluation. Results thereof are shown in Table 1.

EXAMPLE 2

As the polymeric charge transporting material, 2 parts of the polymer (weight average molecular weight: 240,000) represented by the following structural formula was dissolved in a mixed solution of 15 parts of monochlorobenzene and 15 parts of tetrahydrofuran. The resulting coating solution was applied on the charge transporting layer of Example 1 by dip coating and dried by heating at 115° C. for 1 hour to form a surface protective layer having a thickness of 5 μm.

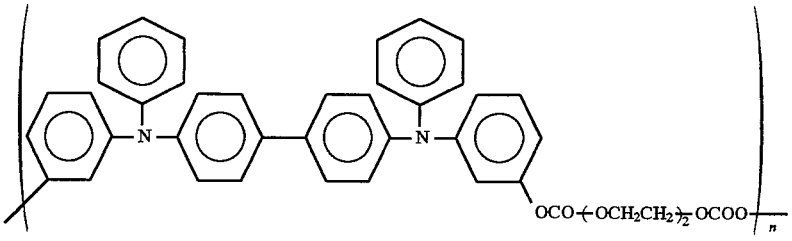

The evaluation was performed in the same manner as with Example 1 with the exception that the photoreceptor thus obtained was used. Results thereof are shown in Table 1.

COMPARATIVE EXAMPLE 3

The evaluation was performed in the same manner as with Comparative Example 1 with the exception that the photoreceptor of Example 2 was used and the image formation was conducted according to the timing shown in FIG. 3. Results thereof are shown in Table 1.

TABLE 1

| | Image Quality after 50,000 Prints | Wear Amount of 50,000 Prints (μm) |
|---|---|---|
| Example 1 | No defect | 4.4 |
| Comparative Example 1 | Wear scratches after 25,000 prints | 8.3 |
| Comparative Example 2 | Toner filming after 30,000 prints | 4.2 |
| Example 2 | No defect | 2.2 |
| Comparative Example 3 | Wear scratches after 45,000 prints | 2.5 |

What is claimed is:

1. An electrophotographic process comprising:

(a) an image forming process comprising:

(i) a charging step of bringing a conductive charging member into contact with a surface of a photoreceptor and applying a superimposed voltage of a direct current voltage and an alternating current voltage to said conductive charging member to directly charge the surface of the photoreceptor, (ii) an image exposing step having an exposure stop point, (iii) a developing step having a developer stop point after said exposure stop point, and (iv) a transfer step having a transfer stop point;

(b) repeating the steps of (i), (ii), (iii) and (iv); and (c) a step of interrupting each application of the direct current voltage, after said exposure stop point and before said developer stop point, and the alternating current voltage to said conductive charging member between each consecutive image exposing step (ii).

2. The electrophotographic process according to claim 1, wherein the direct current voltage and the alternating current voltage are stopped from being applied in this order in step (c).

3. The electrophotographic process according to claim 1, wherein each application of the direct current voltage and the alternating current voltage are restarted at the same time.

4. The electrophotographic process according to claim 1, wherein said photoreceptor comprises a conductive support having thereon a charge generating layer and a charge transporting layer in this order.

5. The electrophotographic process according to claim 4, wherein said charge transporting layer contains a polymeric charge transporting material.

* * * * *